US008297101B2

(12) United States Patent
Bowman et al.

(10) Patent No.: US 8,297,101 B2
(45) Date of Patent: Oct. 30, 2012

(54) APPARATUS AND METHOD FOR FORMING WIRE LOOPS FOR A DYNAMOELECTRIC MACHINE

(75) Inventors: Daniel J. Bowman, Greenfield, IN (US); David M. Kroll, Pendleton, IN (US); Sang-Soo Choi, Indianapolis, IN (US); Richard E. Trammell, Noblesville, IN (US)

(73) Assignee: Remy Technologies, L.L.C., Pendleton, IN (US)

( * ) Notice: Subject to any disclaimer, the term of this patent is extended or adjusted under 35 U.S.C. 154(b) by 819 days.

(21) Appl. No.: 12/045,882

(22) Filed: Mar. 11, 2008

(65) Prior Publication Data

US 2009/0229337 A1 Sep. 17, 2009

(51) Int. Cl.
*B21D 13/00* (2006.01)

(52) U.S. Cl. ..... 72/379.6; 72/381

(58) Field of Classification Search ..... 72/380, 72/381, 383–385, 379.6, 412, 702
See application file for complete search history.

(56) References Cited

U.S. PATENT DOCUMENTS 4,304,116 A * 12/1981 Velarde ..... 72/383
5,007,264 A * 4/1991 Haack ..... 72/17.3
2004/0261256 A1 12/2004 Sadiku

* cited by examiner

*Primary Examiner* — Dana Ross
*Assistant Examiner* — Matthew G Katcoff
(74) *Attorney, Agent, or Firm* — Cantor Colburn LLP

(57) ABSTRACT

An apparatus and method for forming at least one end turn and one slot segment of a coil for a stator of a dynamoelectric machine includes the utilization of a plurality of forming dies. Each forming die includes two lateral surfaces extending from a base and an end turn surface disposed substantially between and connecting the two lateral surfaces. Each forming die is disposed and pivotable into an arrangement where at least one lateral surface of a first forming die is substantially adjacent and parallel to at least one lateral surface of a second forming die, a slot segment thereby formable between lateral surfaces of adjacent forming dies and an end turn is at least partially formable between an end turn surface and a base of adjacent forming dies.

4 Claims, 4 Drawing Sheets

10

10

APPARATUS AND METHOD FOR FORMING WIRE LOOPS FOR A DYNAMOELECTRIC MACHINE

BACKGROUND OF THE INVENTION

The present invention relates generally to dynamoelectric machines. More specifically, this invention relates to an apparatus and method for forming a stator winding for a dynamoelectric machine into a desired shape.

A dynamoelectric machine, such as an electric motor, an electric generator, or a vehicle alternator, contains, among other things, a stationary component known as a "stator," and a rotating component known as a "rotor." In the most common embodiment, the perimeter of the rotor and an inside configuration of the stator are cylindrical in shape. It is known in the art that a stator and a rotor each may be manufactured from a core made from a magnetic material, around which or within which insulated electrical conductors known as "windings" or "coils" are installed.

A typical stator of a design known in the art comprises a hollow, cylindrical core, the inner surface of which contains slots, which extend the full length of the core parallel to the axial direction of the core. The portions of the stator core between the slots are known as the "teeth." These teeth extend radially inward toward the center of the core.

Stator windings, commonly formed from insulated conductors of, for example, copper, comprise slot sections and end turns, with the slot sections being disposed in the stator slots and the end turns traversing a distance between sequential slot sections. Multiple layers of slot sections are disposed in each stator slot until a desired stator fill is achieved. It is desirable to maximize an amount of conductor within each stator slot, therefore the stator windings must be formed and placed on the stator core such that the layers nest together minimizing and gaps between layers in the stator slots. To promote the nesting of the various layers together, it is desirable to form the end turns to a precise shape, without damaging the conductor insulation during the forming process.

SUMMARY OF THE INVENTION

An apparatus and method for forming at least one end turn and one slot segment of a coil for a stator of a dynamoelectric machine includes the utilization of a plurality of forming dies. Each forming die includes two lateral surfaces extending from a base and an end turn surface disposed substantially between and connecting the two lateral surfaces. Each forming die is disposed and pivotable such that when forming dies of the plurality of forming dies are sequentially pivoted into an arrangement where at least one lateral surface of a first forming die is substantially adjacent and parallel to at least one lateral surface of a second forming die, a slot segment is formable between lateral surfaces of adjacent forming dies and an end turn is at least partially formable between an end turn surface and a base of adjacent forming dies.

A method of forming at least one end turn and at least one slot segment in a conductor for a stator of a dynamoelectric machine includes locating a conductor between at least a first forming die and a second forming die of a plurality of forming dies. The first forming die is pivoted toward the conductor, capturing at least a portion of the conductor between the first forming die and the second forming die. The second forming die is pivoted toward the first forming die, forming a slot segment between a lateral surface of the first forming die and a lateral surface of the second forming die, and the conductor is forced against the second forming die, thus creating the desired end turn shape in the conductor between the end turn surface of the first forming die and the base of the second forming die.

DESCRIPTION OF THE DRAWINGS

The above, as well as other advantages of the present invention, will become readily apparent to those skilled in the art from the following detailed description when considered in the light of the accompanying drawings in which.

DETAILED DESCRIPTION OF THE INVENTION

Figure 1:
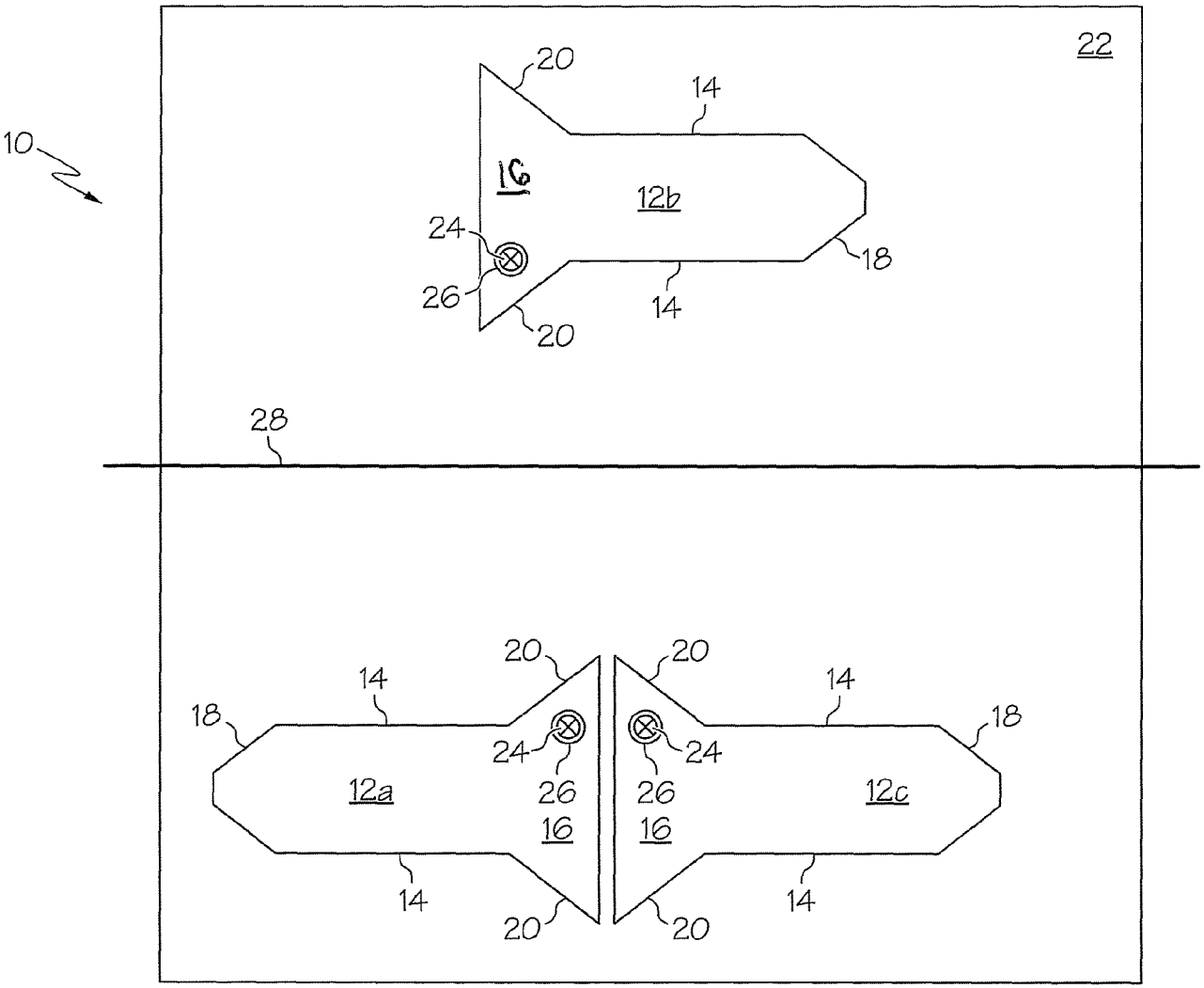
FIG. 1 is a plan view of an embodiment of a conductor forming tool.

Shown in FIG. 1 is a conductor forming tool 10 utilized to form end turns in conductors to be assembled into stator windings. The conductor forming tool 10 includes a plurality of forming dies 12*a-c*. Each of the forming dies 12*a-c* includes two lateral surfaces 14 extending from a base 16 of the forming die 12*a-c*. The lateral surfaces 14 of the forming die 12*a-c* of FIG. 1 are substantially straight and parallel to each other, but other configurations of lateral surfaces 14 are contemplated within the scope of the present disclosure.

An end turn surface 18 is disposed between the lateral surfaces 14, connecting one lateral surface 14 to the other lateral surface 14. The end turn surface 18 is configured to enable a desired end turn shape to be formed utilizing the forming dies 12*a-c*. In the embodiment illustrated in FIG. 1, the end turn surface 18 is a convex, gable-shaped surface to enable the formation of a gable-shaped end turn. Other configurations of end turn surfaces 18, for example, V-shaped or semi-circular-shaped, are also contemplated within the present scope.

The base 16 of each forming die 12*a-c* includes a base turn surface 20 extending from each lateral surface 14. Each base turn surface 20 is configured as a convex surface and is substantially half of the shape of the end turn surface 18. For example, if the end turn surface 18 is gable-shaped as in FIG. 1, each base turn surface 20 is substantially half-gable shaped matching half of the end turn surface 18.

Figure 2:
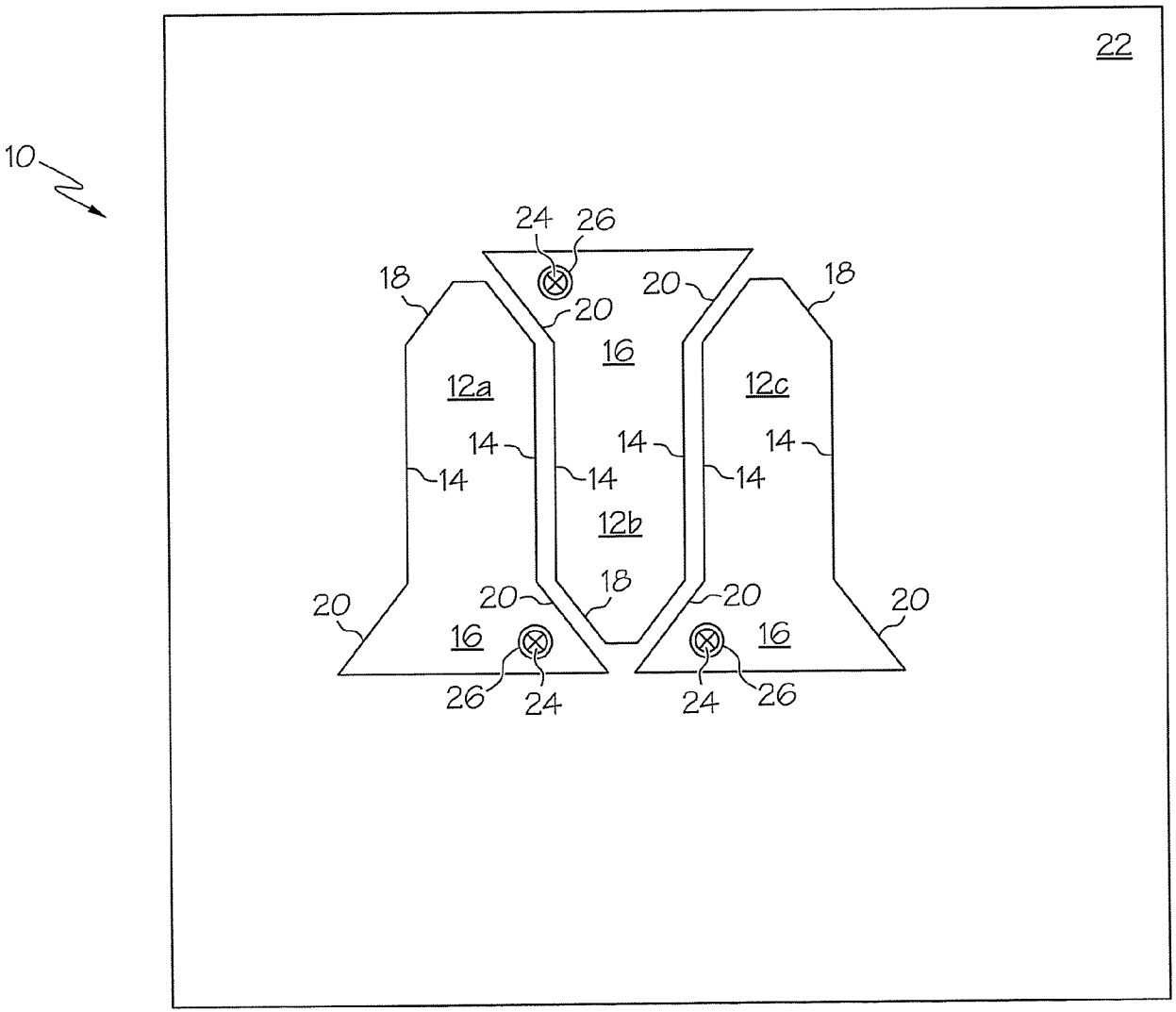
FIG. 2 is a plan view illustrating the dies of the conductor forming tool of FIG. 1 in a forming position.

The forming dies 12*a-c* are arranged on a plate 22 or other substantially planar work surface, and are pivotably fixed at the base 16 to the plate 22. The forming dies 12*a-c* may be pivotably fixed utilizing a pin 24, or other fastener, for example, a bolt or screw or the like, which extends through each forming die 12*a-c* at a pivot hole 26. The forming dies 12*a-c* are arranged such that when they are pivoted to a forming position as shown in FIG. 2, lateral surface 14 of a first forming die 12*a* abuts a lateral surface 14 of a second forming die 12*b* and a lateral surface 14 of the second forming die 12*b* abuts a lateral surface 14 of a third forming die 12*c*. It is to be appreciated that three forming dies 12*a-c* are shown for illustrative purposes only, and that any number of forming dies 12*a-c* may be utilized in the conductor forming tool 10.

The forming dies 12*a-c* are further arranged such when the forming dies 12*a-c* are pivoted to the forming position, adjacent forming dies 12*a-c* face in opposing directions. In other words, the end turn surface 18 of the first forming die 12*a* abuts the base turn surface 20 of the second forming die 12*b*. Further, the end turn surface 18 of the second forming die 12*b* abuts the base turn surface 20 of the first forming die 12*a* and the third forming die 12*c*. The end turn surface 18 of the third forming die 12*c* abuts the base turn surface 20 of the second forming die 12*b*. Additional forming dies 12*a-c*, if utilized, may also be arranged in this alternating configuration.

Figure 3:
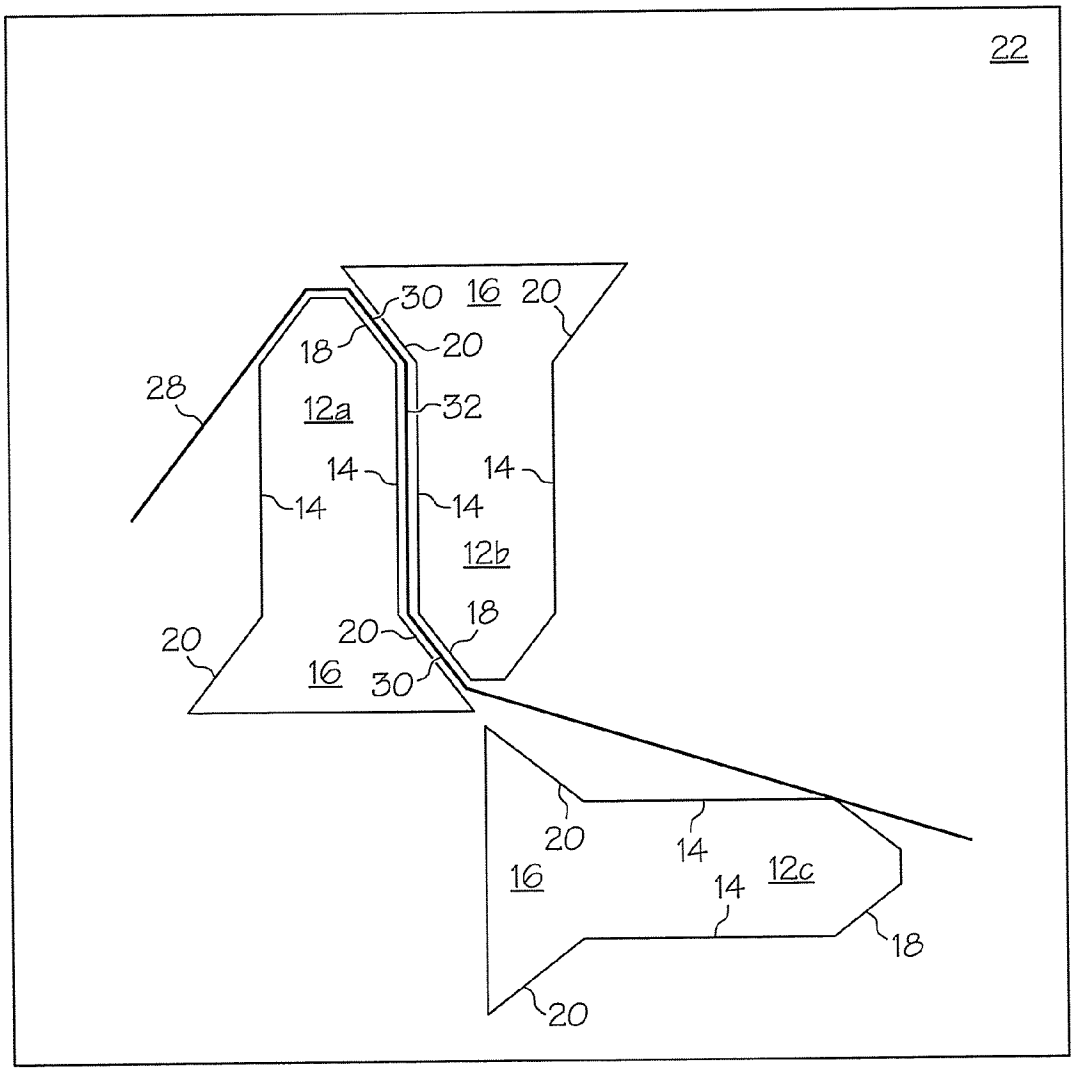
FIG. 3 illustrates the conductor forming tool of FIG. 1 with two dies in the forming position.
Figure 4:
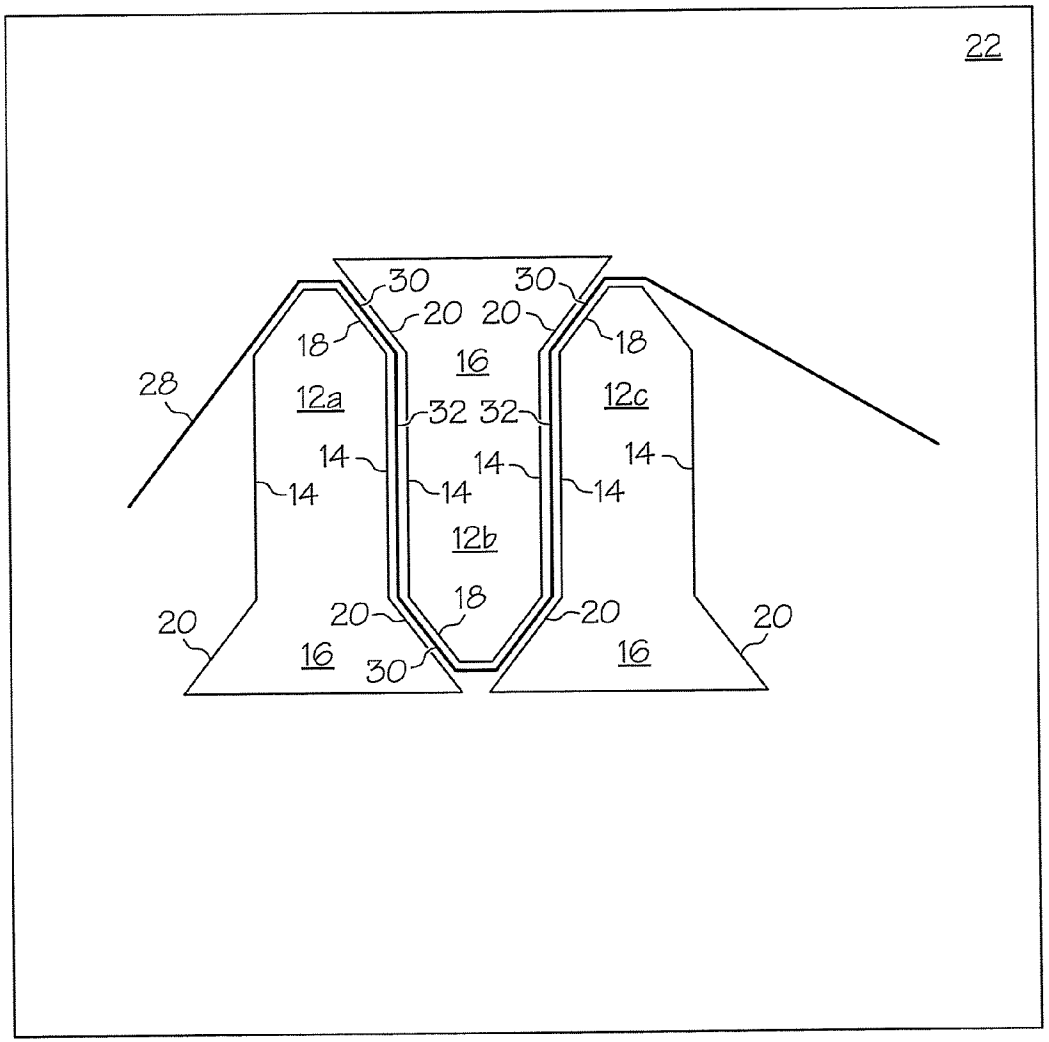
FIG. 4 illustrates the conductor forming tool of FIG. 1 with three dies in the forming position.

To form a series of end turns in the conductor, a conductor 28, which may be pre-cut to a desired length, is placed on the plate 22 while the forming dies 12*a-c* are located in a loading position radially outboard of the conductor 28 as shown in FIG. 1. Referring now to FIG. 3, the first forming die 12*a* and second forming die 12*b* are actuated and pivoted toward the forming position by a mechanical actuator or the like. During this motion, the conductor 28 is captured between the adjacent lateral surfaces 14 of the first forming die 12*a* and second forming die 12*b*. Further, portions of end turns 30 are formed between the end turn surface 18 of the first forming die 12*a* and the base turn surface 20 of the second forming die 12*b*, and between the base turn surface 20 of the first forming die 12*a* and the end turn surface 18 of the second forming die 12*b*. Additionally, a stator slot segment 32 is formed from the conductor 28 captured between lateral surface 14 of the first forming die 12*a* and abutting lateral surface 14 of the second forming die 12*b*. The third forming die 12*c* is then actuated and pivoted into forming position as shown in FIG. 4 by a mechanical actuator or the like. As the third forming die 12*c* is pivoted, the conductor 28 is captured between the end turn surface 18 of the second forming die 12*b* and the base turn surface 20 of the third forming die 12*c*, thus completing the formation of end turn 30 at the second forming die 12*b*. The conductor 28 is further captured between abutting lateral surfaces 14 of the second forming die 12*b* and the third forming die 12*c* forming stator slot segment 32, and an additional portion of an end turn 30 is formed between end turn surface 18 of the third forming die 12*c* and the base turn surface 20 of the second forming die 12*b*. To form additional end turns 30 and stator slot segments 32 in the conductor 28, additional forming dies 12 may be added to the plate 22 and the forming process before first forming die 12*a* and/or after third forming die 12*c*.

Forming the end turns 30 using the above-described forming dies 12*a-c* and process results in conductors 28 having the desired shape of end turns 30 to have the desired nesting properties when installed in a stator core. Use of the forming dies 12*a-c* and the associated process minimizes process steps necessary to form the end turns 30 and stator slot segments 32 of a stator winding and minimizes the length of conductor 28 that contacts the forming dies 12*a-c* during the forming process thereby reducing the risk of damage to the conductor 28.

While embodiments of the invention have been described above, it will be understood that those skilled in the art, both now and in the future, may make various improvements and enhancements which fall within the scope of the claims which follow. These claims should be construed to maintain the proper protection for the invention first described.

What is claimed is:

1. A method of forming at least one end turn and at least one slot segment in a conductor for a stator of a dynamoelectric machine comprising:

locating a conductor between at least a first forming die and a second forming die of a plurality of forming dies, the first forming die and second forming die pivotably disposed, each forming die of the plurality of forming dies including two lateral surfaces extending from a base and an end turn surface disposed substantially between and connecting the two lateral surfaces;

pivoting the first forming die toward the conductor;

capturing at least a portion of the conductor between the first forming die and the second forming die;

pivoting the second forming die until at least a first lateral surface of the first forming die is substantially parallel to and adjacent to a second lateral surface of the second forming die;

forming a slot segment between the first lateral surface and the second lateral surface; and forcing the conductor against the second forming die, thus creating the desired end turn shape in the conductor between the end turn surface of the first forming die and the base of the second forming die.

2. The method of claim 1 wherein the conductor is captured between an end turn surface of the first die and a base turn surface of the second die.

3. The method of claim 1 wherein the end turn surface is gable-shaped.

4. The method of claim 1 wherein the first die and the second die are rotably mounted to a plate.

* * * * *